US005566533A

United States Patent [19]

Larisch

[11] Patent Number: 5,566,533

[45] Date of Patent: Oct. 22, 1996

[54] STABILIZER SADDLE GIRTH

[75] Inventor: Linda G. Larisch, Lowell, Mich.

[73] Assignee: Kimberlite Acres, Inc., Lowell, Mich.

[21] Appl. No.: 379,729

[22] Filed: Jan. 27, 1995

[51] Int. Cl.[6] ..... B68C 1/14

[52] U.S. Cl. ..... 54/23

[58] Field of Search ..... 54/23, 35, 71

[56] References Cited

U.S. PATENT DOCUMENTS

| | | | |
|---|---|---|---|
| 266,571 | 10/1882 | Willilams . | |
| 302,019 | 7/1884 | Parshall | 54/71 |
| 370,208 | 9/1887 | Pefley . | |
| 532,906 | 1/1895 | Rahn . | |
| 1,678,373 | 7/1928 | Wiesenfeld . | |
| 1,759,172 | 5/1930 | Smalley | 54/71 |
| 3,805,491 | 4/1974 | Deal | 54/23 |
| 3,828,521 | 8/1974 | Dulaney | 54/23 |
| 4,132,055 | 1/1979 | Bird | 54/23 |
| 4,434,604 | 3/1984 | Bird | 54/23 |
| 4,709,539 | 12/1987 | Bird | 54/23 |
| 4,999,980 | 3/1991 | McGowan | 54/23 |
| 5,134,836 | 8/1992 | Harty | 54/23 |
| 5,426,924 | 6/1995 | Harty | 54/23 |

FOREIGN PATENT DOCUMENTS

| | | | |
|---|---|---|---|
| 575896 | 8/1924 | France | 54/23 |
| 160614 | 3/1921 | United Kingdom | 54/23 |

*Primary Examiner*—Robert P. Swiatek

*Attorney, Agent, or Firm*—Price, Heneveld, Cooper, DeWitt and Litton

[57] ABSTRACT

A saddle girth comprising an elongated, flexible girth band and a pair of elongated girth straps extending beyond the length of the girth band for attachment to saddle billets on opposite sides of a horse, the elongated girth straps crossing each other at the centers thereof such that each strap is positioned forwardly of the other strap at one end and rearwardly of the other strap at the opposite end, the girth straps being longitudinally movable relative to each other and relative to the girth band, and keepers cooperative with the girth band and girth straps, located to keep the girth straps positioned as noted above.

23 Claims, 2 Drawing Sheets

STABILIZER SADDLE GIRTH

BACKGROUND OF THE INVENTION

This invention relates to saddle girths for horses, and particularly to a novel stabilizer saddle girth.

Saddle girths for horses, particularly those used with the style of saddle commonly known as an "English" saddle, typically employ a girth, usually of leather, extending around and beneath the chest of the horse, just behind the front legs. Such a girth usually has two or three buckles at each end for attachment to two or three billets on the two sides of the saddle.

In rapid action events such as jumping, dressage or during polo games, girth and saddle arrangements typically allow considerable movement of the saddle laterally and longitudinally on the horse. For example, in a polo game, the rider will put more weight on the stirrup on the side of the horse where the ball is to be hit, tending to cause the saddle to rotate several degrees to that side. A significant amount of such movement can be not only disconcerting to the rider, but can also cause chafing of the horse's withers and/or back, as well as causing discomfort to the horse's rib cage, shoulder blades and/or skin due to the girth moving repeatedly from side-to-side and/or front-to-back beneath the horse with movement of the saddle.

SUMMARY OF THE INVENTION

An object of this invention is to provide a unique saddle girth that has been found to stabilize the saddle on the horse's back, even during rapid action events. The novel girth employs a unique arrangement of a pair of elongated, crisscrossed girth straps which cross at their centers beneath the horse's chest, over a girth band that stays basically stationary on the horse's chest, but are free to move longitudinally independent of each other. The girth straps are detained in fore-to-aft position on the band, but are free to move longitudinally relative to each other and to the band, in a fashion that has been found to be particularly advantageous. Each girth strap has one end forward of the adjacent end of the other strap, and the opposite end rearward of the adjacent end of the other strap, crossing each other at the centers thereof. Keepers retain the straps in fore-to-aft position on the girth band while allowing this longitudinal movement of the straps. These keepers can, for example, be in the form of loops as illustrated in one embodiment herein, or portions of a sleeve with stitches as illustrated in another embodiment herein. The straps can be exterior of the band as illustrated in one embodiment herein, or preferably interior of the band as illustrated in the other embodiment herein.

These and other objects, advantages and features of the invention will become apparent upon studying the following specification in conjunction with the drawings.

Figure 1:
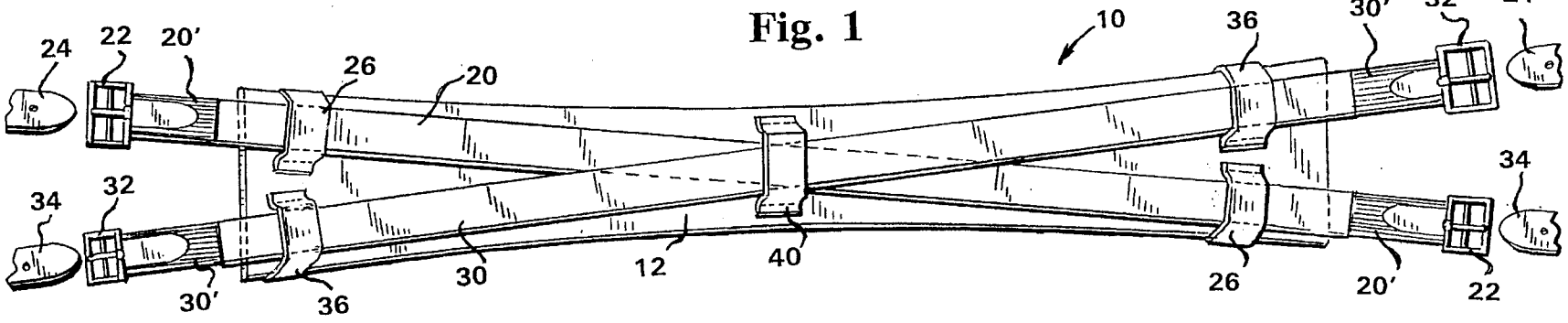
FIG. 1 is a perspective view of one embodiment of the novel girth.

Referring now specifically to the embodiment in FIG. 1, the saddle girth assembly 10 includes an elongated band 12 as of leather, felt padded leather, or alternative materials such as nylon, cotton or neoprene. It can be of one solid piece in cross section, or a loop in cross section. This band is flexible so as to readily encompass the underside portion of the chest of a horse. Cooperative with this elongated band is a pair of elongated leather girth straps 20 and 30, each of which has a length greater than the length of band, to extend therebeyond on both ends as shown by portions 20' and 30'. Preferably a substantial section of these extending portions 20' and 30' is formed of an elastomeric material of one, two or three layers thickness, for example. At the ends of these girth straps are conventional buckles 22 and 32 of any selected type for attachment to conventional saddle billets 24 and 34, respectively. Such billets are typically stitched to the saddle, as is well known.

Girth straps 20 and 30 crisscross each other at the centers thereof and at the center of girth band 12, with one end 20' and its buckle 22 being forward of the end 30' and of buckle 32, and the opposite end 20' and its buckle 22 being behind, i.e., rearward of, end 30' and of buckle 32. Hence, one buckle 22 of one strap will attach to a forward billet 24 while the other buckle 22 thereof will attach to a rearward billet 34, and likewise one buckle 32 of the other strap will attach to a rearward billet 34 while its opposite end buckle 32 will attach to a forward billet 24.

The individual girth straps are free to move longitudinally independently of each other, as well as independently of girth band 12. However, they are kept in cooperative relationship with the band and with each other, as well as in a predetermined front-to-rear, i.e., fore-to-aft, position of the band, by keepers. More specifically, in this first embodiment, on one end of girth band 12 is a pair of keepers in the form of loops 26 and 36 which are stitched or otherwise attached to band 12 at the opposite ends of the keeper loops, so that the ends of straps 20 and 30 can slide longitudinally between the loops and band 12, but be retained to the band. At the opposite ends of straps 20 and 30 is an additional pair of keepers or loops 36 and 26 for straps 30 and 20. These loops are likewise stitched or otherwise secured to band 12 to allow the straps to slide between the loops and the band, but be retained to the band. If desired, the individual end loops 26 and 36 can be part of the same element stitched at its opposite ends and also at its center between the two straps. In the center of the straps and the band, i.e., at the area where straps 30 and 20 cross, is shown another keeper in the form of a loop 40 stitched at its opposite ends to the band 12, and beneath which both straps are retained adjacent the band but allowed to slide longitudinally relative to the loop 40 and band 12.

Figure 2:
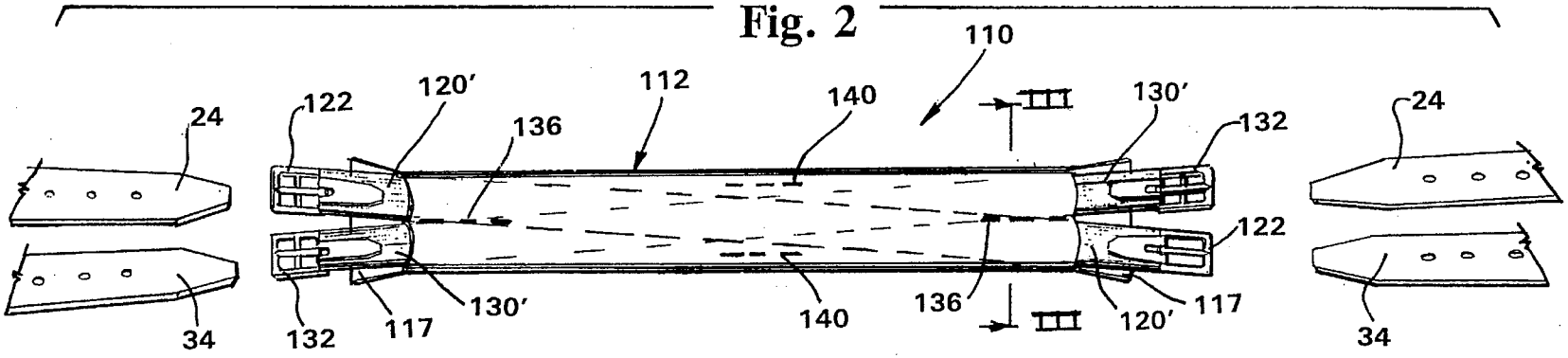
FIG. 2 is a perspective view of a second embodiment of the novel girth.
Figure 4:
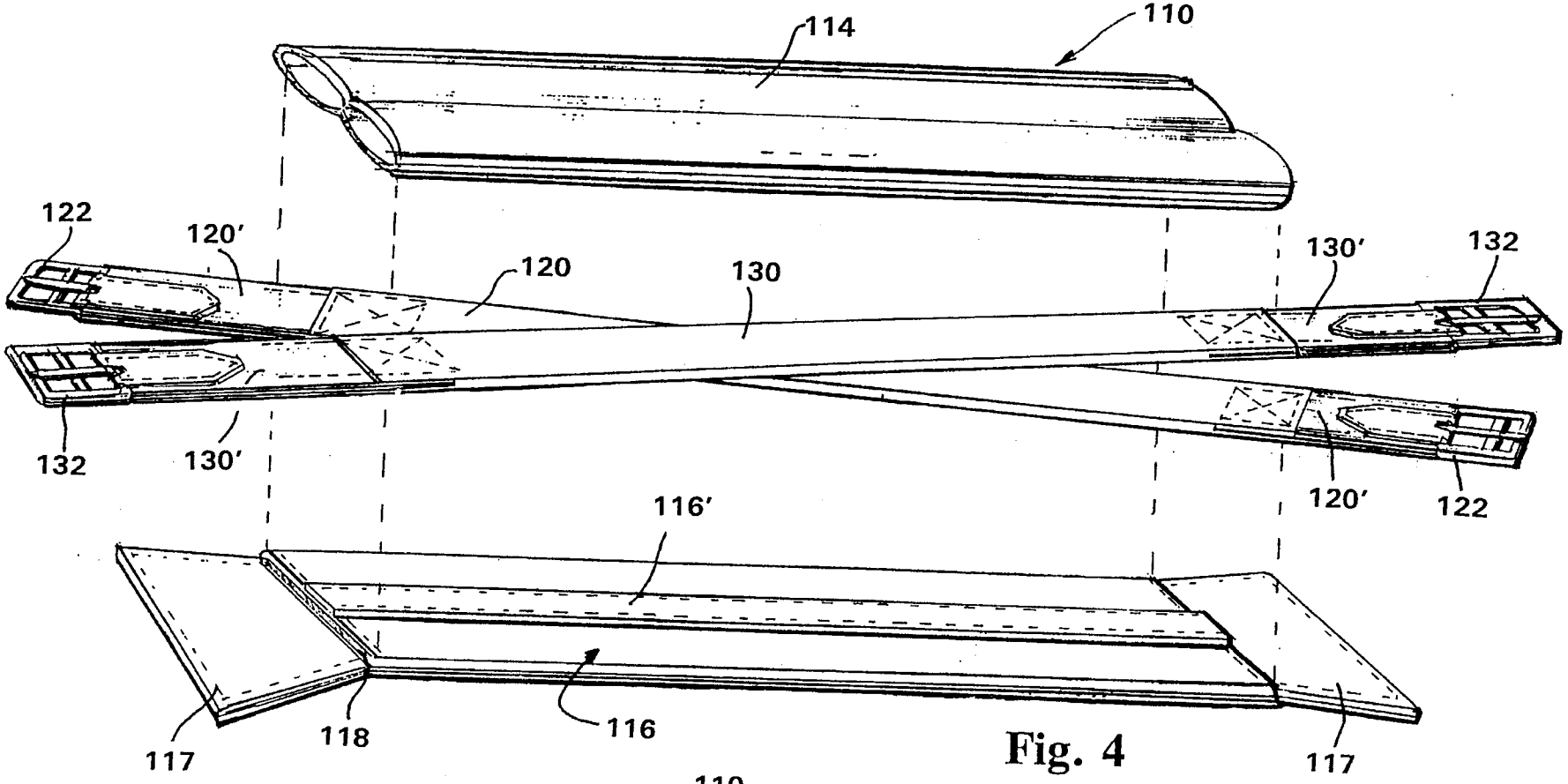
FIG. 4 is an exploded view of the second embodiment in FIG. 2.
Figure 3:
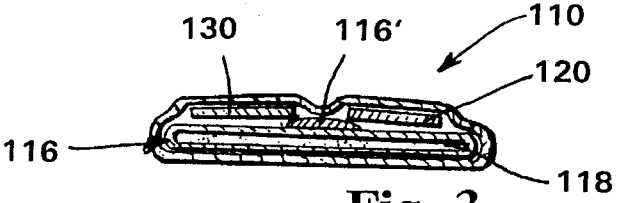
FIG. 3 is a sectional view taken on plane III—III of FIG. 2.

In FIGS. 2–4 is shown a second embodiment of the novel girth. This girth assembly 110 also has an elongated band 112 and a pair of elongated straps 120 and 130 crossed with each other at their center. In this embodiment, however, band 112 comprises a sheath or sleeve 114 through the interior of which straps 120 and 130 extend, and an elongated base 116. This base is shown as a loop (in cross section) to form two layers of leather or the like enclosing a layer of padding, preferably felt 118. The ends of base 116 preferably have integral flaps 117 that extend beyond the sleeve 114 for extra comfort for the horse. A reinforcing rib 116' extends along and overlaps the seam of base 116.

Straps 120 and 130 are longer than band 112 to extend beyond the ends of band 112. At the ends 120' and 130' of straps 120 and 130 are conventional buckles 122 and 132. Ends 120' and 130' are preferably of an elastic material, while straps 120 and 130, as well as band 112, are preferably of leather. Here again, straps 120 and 130 are each free to move longitudinally with respect to each other and with respect to band 112. Each strap has one end forward of the other strap, and an opposite end rearward of the other strap, relative to the horse and saddle. The straps are retained in this crossed relationship by keepers which are shown to be in the form of portions of the band and adjacent rows of stitches in the band, to secure the top and bottom layers of the band together at these locations. Specifically, at each end of band 112 between straps 120 and 130 are stitches 136. In the center of band 112, astraddle both crossed straps 120 and 130, are keepers also in the form of portions of upper and lower layers of the band and adjacent stitches 140 therethrough, retaining the straps together in their crossed condition but allowing them to move longitudinally with respect to each other and the band. These stitches could be substituted by rivets or the equivalent.

In both embodiments, the straps are not attached to each other nor to the band, so as to thereby have independent freedom of movement, longitudinally of the straps.

Considerable testing of the girth has shown that it is exceptional in its performance in keeping the saddle stabilized laterally and longitudinally, keeping the girth band generally stationary beneath the chest of the horse. This stability provides comfort to the animal as well as security for the rider.

Conceivably those skilled in this art, once realizing the nature of this development, could make minor modifications therein without departing from the concept set forth, so as to suit a particular type of event or animal. Therefore, the invention is not intended to be limited to the specific preferred embodiments set forth above as exemplary of the invention, but only by the scope of the appended claims and the legally equivalent structures to those defined therein.

The embodiments of the invention in which an exclusive property or privilege is claimed are defined as follows:

1. A saddle girth comprising:

an elongated, flexible girth band;

a pair of elongated girth straps extending the length of said girth band and having portions extending beyond said girth band for attachment to saddle billets on opposite sides of a horse;

said pair of elongated girth straps crossing each other at the centers thereof such that each strap is positioned forwardly of the other strap at one end and rearwardly of the other strap at the opposite end;

said girth straps being longitudinally movable relative to each other and relative to said girth band; and keepers cooperative with said girth band and said girth straps located to keep said girth straps so positioned.

2. The saddle girth in claim 1 wherein said keepers are adjacent each end of said girth band.

3. The saddle girth in claim 2 including a central keeper at the crossed centers of said girth straps.

4. The saddle girth in claim 1 wherein said girth straps each include elastomeric ends.

5. The saddle girth in claim 4 wherein said girth strap elastomeric ends extend beyond said girth band.

6. The saddle girth in claim 1 wherein said girth straps each having a front buckle at one end and a rear buckle at the opposite end.

7. The saddle girth in claim 1 wherein said keepers comprise loops attached to said girth band and through which said straps extend.

8. The saddle girth in claim 7 wherein said loops comprise a pair of loops at each end of said girth band.

9. The saddle girth in claim 8 including a loop centrally of said band and through which both of said crossed straps extend.

10. The saddle girth in claim 1 wherein said girth band comprises a sleeve and said straps extend through said sleeve.

11. The saddle girth in claim 10 wherein said keepers comprise portions of said sleeve and stitches in said sleeve.

12. The saddle girth in claim 11 including stitches comprising a keeper centrally of said girth band adjacent and astraddle of said centers of said straps.

13. The saddle girth in claim 10 including an elongated base extending within said sleeve.

14. The saddle girth in claim 13 wherein said sleeve has ends and said base extends beyond said ends of said sleeve.

15. The saddle girth in claim 14 wherein said base includes a padding layer.

16. The saddle girth in claim 15 wherein said padding layer is felt.

17. The saddle girth in claim 15 wherein said base comprises a pair of layers encompassing said padding layer.

18. The saddle girth in claim 17 wherein said keepers comprise portions of said sleeve and stitches in said sleeve.

19. A saddle girth comprising:

an elongated, flexible girth band;

a pair of elongated girth straps extending the length of said girth band and having portions extending beyond said girth band for attachment to saddle billets on opposite sides of a horse;

said pair of elongated girth straps crossing each other at the centers thereof such that each strap is positioned forwardly of the other strap at one end and rearwardly of the other strap at the opposite end;

said girth straps being longitudinally movable relative to each other and relative to said girth band;

keeper loops at each end of said girth straps, attached to said girth band and through which respective ones of said straps extend, to keep said girth straps so positioned; and a keeper loop centrally of said band, attached to said band and through which both of said crossed straps extend.

20. A saddle girth comprising:

an elongated, flexible girth band, said band comprising a sleeve;

a pair of elongated girth straps extending through said girth band and having portions extending beyond said girth band for attachment to saddle billets on opposite sides of a horse;

said pair of elongated girth straps crossing each other at the centers thereof such that each strap is positioned forwardly of the other strap at one end and rearwardly of the other strap at the opposite end;

said girth straps being longitudinally movable relative to each other and relative to said girth band;

keeper stitches into said girth band at each end of said girth straps, located to keep said girth straps so positioned, and keeper stitches centrally of said girth band and adjacent which said crossed straps extend, allowing said girth straps to move longitudinally thereof relative to said stitches, said band, and each other.

21. The saddle girth in claim 20 including an elongated base extending within said sleeve.

22. The saddle girth in claim 21 wherein said sleeve has ends and said base extends beyond said ends of said sleeve, and said base includes a padding layer.

23. The saddle girth in claim 22 wherein said base comprises a pair of layers encompassing said padding layer, and said keepers comprise portions of said sleeve and stitches in said sleeve.

* * * * *